United States Patent [19]

Coucher

[11] 3,934,829

[45] Jan. 27, 1976

[54] NOVEL WAY SYSTEM

[76] Inventor: Robert G. Coucher, 2021 Ribbon Lane, Salt Lake City, Utah 84117

[22] Filed: Aug. 26, 1974

[21] Appl. No.: 500,272

[52] U.S. Cl. ..... 241/259.1; 248/23

[51] Int. Cl.[2] ..... B02C 7/14

[58] Field of Search ..... 241/259.1, 286; 248/23

[56] References Cited

UNITED STATES PATENTS

| | | | |
|---|---|---|---|
| 950,868 | 3/1910 | Sanburn | 241/259.1 |
| 1,011,835 | 12/1911 | Noble | 241/259.1 |
| 1,705,996 | 3/1929 | Pope | 241/259.1 X |
| 3,638,871 | 2/1972 | Barger | 241/259.1 |

*Primary Examiner*—Granville Y. Custer, Jr.
*Assistant Examiner*—Howard N. Goldberg
*Attorney, Agent, or Firm*—Trask & Britt

[57] ABSTRACT

A way system for mounting motors to a panel with the motor on one side and the ways on the opposite side of the panel. The ways may be mounted beneath the motor support base of a home grain mill with the motor spaced from the upper surface of the base to advance and retract a rotor stone with respect to a stator stone.

4 Claims, 4 Drawing Figures

FIG. 1.
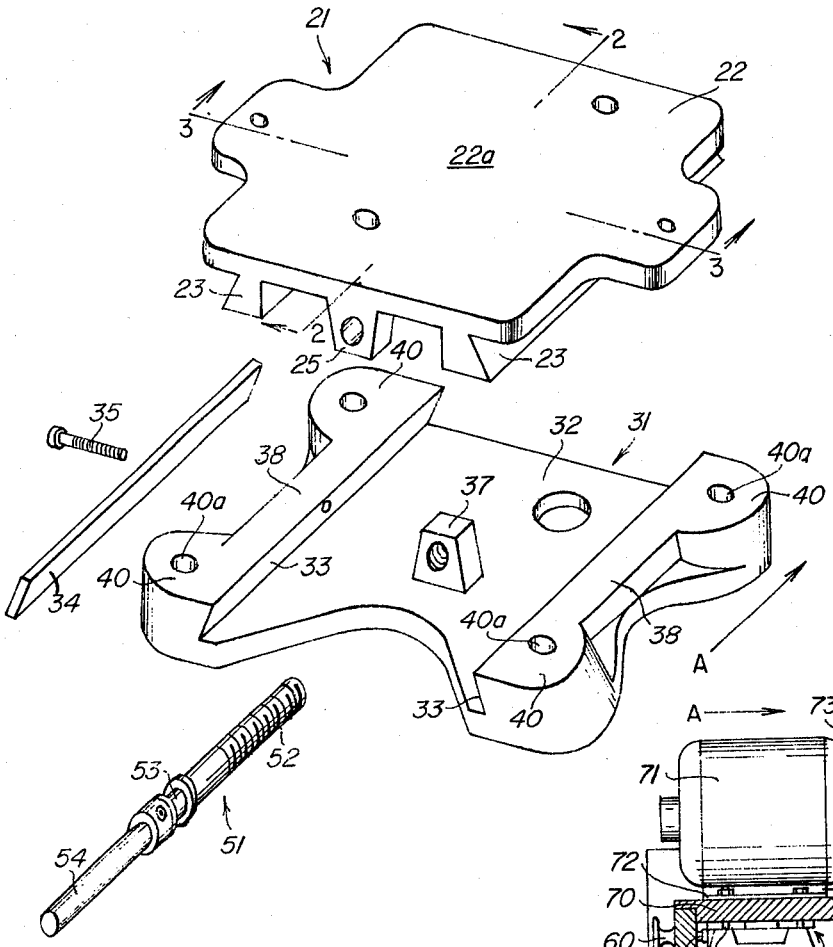
FIG. 4.
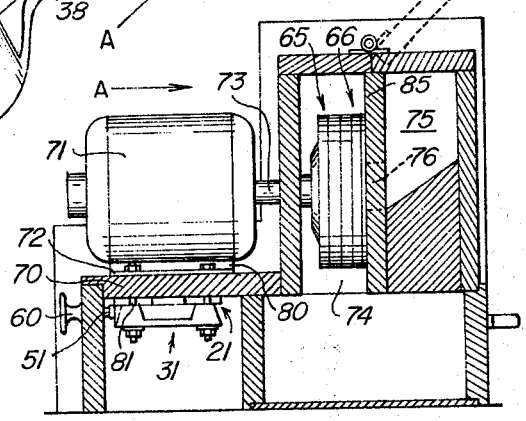
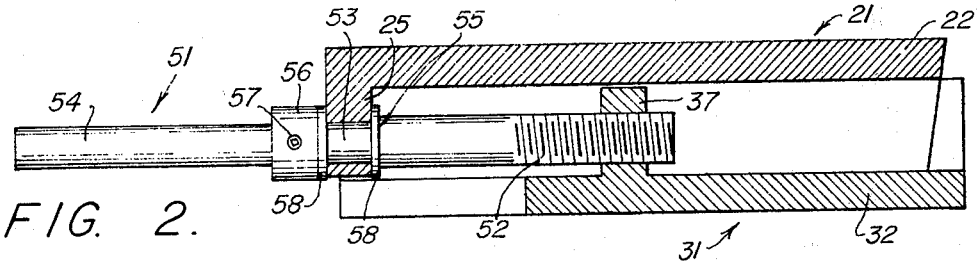
FIG. 2.
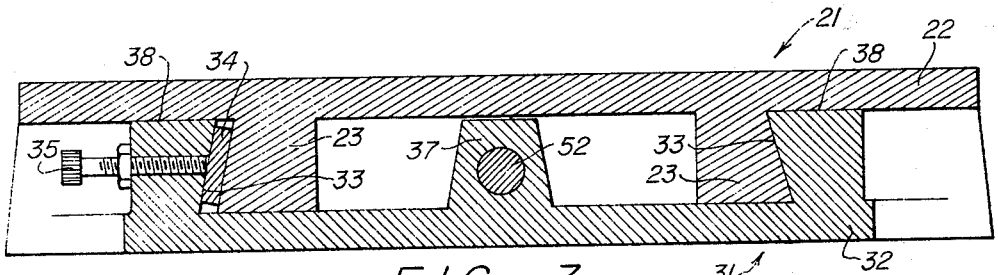
FIG. 3.

NOVEL WAY SYSTEM

BACKGROUND OF THE INVENTION

Field

This invention relates to way systems and provides an improved such system ideally adapted for use in grain mills and the like.

State of the Art

Way systems are conventionally used in machine tools and other equipment to hold tool posts, work pieces, head stocks, tail stocks, etc. rigidly but adjustably along a defined reference line or plane. Considerable ingenuity is required to adapt way systems to specific applications, thereby to gain the advantages offered by such systems.

Many types of grain mills are known. They generally include a stator grinding wheel and a rotor grinding wheel driven, either directly or through couplings, by an electric motor. The grinding wheels are mounted in approximately axial alignment with each other and the shaft of the motor. The fineness of grind of flour produced by such mills is a function of the spacings of the grinding surfaces carried by the stator and rotor elements. Various approaches to adjusting this spacing have been attempted, but none has been completely satisfactory. Moving either the stator or the rotor tends to disturb the axial alignment of these elements, causing functional and operational difficulties. Moving the stator has been less satisfactory than moving the rotor and is considered to be an undesirable expedient.

SUMMARY OF THE INVENTION

The present invention provides a novel way system especially adapted to be mounted against one side (e.g., the under surface) of a mounting panel to move an electric motor mounted on the opposite side of the panel forth and back in the direction of the axis of the motor shaft. The mounting panel may comprise a table or bench top, but of most interest from the standpoint of this invention, it may be the motor-supporting panel of a home grain mill.

The way system includes a stationary element which is fixed to the mounting panel and a moving element. These two elements are interconnected by ways and an adjustment shaft adapted to advance and retract (withdraw) the moving element by rotating the shaft in one direction or the other. A most significant aspect of the way system claimed herein is that a motor is mounted opposite the mounting panel from the ways by means of posts, preferably adjustable in length, extending through slots or holes in the mounting panel, to rigidly fasten the motor to the movable way element. The motor is thus in effect suspended from the panel, although it is normally physically located above the panel. In this fashion, the operating mechanism of the way system may be substantially completely hidden from view. Moreover, the motor may be mounted only slightly (e.g., 1/16 inch) above the top surface to the mounting panel without regard to the physical dimensions of the way system. These features make possible the use of the system in applications such as home grain mills.

As applied to a home grain mill, the way system of this invention advances the entire motor forward or backward while maintaining the distal end of the motor shaft at an exactly constant elevation. This characteristic offers a distinct advantage over grain mills of the prior art which move the motor shaft (journaled within bearings) axially with respect to rigidly mounted motors. Motor shafts are rarely precisely positioned with respect to the axis or center line of the motor casing or its associated mounting frame.

BRIEF DESCRIPTION OF THE DRAWINGS

In the drawings which illustrate what is now regarded as the best mode for carrying out the invention:

FIG. 1 is an exploded pictorial view illustrating the various component parts of the way system of this invention;

FIG. 2 is a cross sectional view, taken along the section line 2—2 of FIG. 1, fully assembled and viewed in the direction indicated by the arrows;

FIG. 3 is a similar view taken along the section line 3—3 of FIG. 1; and FIG. 4 is a fragmentary view, partially in section, illustrating the way system of this invention installed as a portion of an improved flour mill.

DESCRIPTION OF THE ILLUSTRATED EMBODIMENT

The way system illustrated includes a first (or stationary) way element 21 with a stationary mounting plate 22, having a planer, flush-mounting upper surface **22*a* and spaced parallel way surfaces 23 depending from the mounting plate 22 opposite the flush-mounting surface 22*a*. A first adjustment lug 25 depends from the mounting plate 22 intermediate and between the way surfaces 23**.

A second (or movable) way element 31 comprises a movable support plate 32 with spaced, parallel way surfaces 33 upstanding from the support plate 32 in position (i.e., appropriate spatial relationship), to register with the depending way surfaces 23, as best shown by FIG. 3. A length of jib stock 34 is inserted between one pair of opposing, registered way surfaces, as shown, and is forced against one surface by set screws 35 to adjust the "feel" (i.e., the resistance to movement in the longitudinal direction) of the assembled way system. A second adjusting lug 37 is provided upstanding, intermediate and between the upstanding way surfaces. A pair of load-bearing platforms 38 is carried by the movable way element 31 in association with respective way surfaces 33 and in approximately parallel relationship with the flush-mounting surface **22*a* of the mounting plate 22**.

Each platform member 38 includes a pair of post sites 40 spaced to coincide, or register, with the corresponding anchoring slots of a conventional electric motor mounting frame. Such frames are a standardized commodity, and are designated for use interchangeably with electric motors of various suppliers. For example, the illustrated way system is conveniently sized to accommodate a No. 56 frame, a frame adapted to receive many of the motors most commonly used with appliances and shop machinery. Minor adjustments to the locations of the holes **40*a* provided in the post sites 40** will readily adapt the way system to other frame mountings.

An adjustment shaft 51 provides means for selectively advancing (the direction indicated by the arrow designated A in FIG. 1) or retracting (the direction opposite the direction indicated by the arrow A) the movable support plate 31 with respect to the stationary mounting plate 21. The shaft 51 includes a first threaded section 52, here illustrated at one end, engaging one of the adjustment lugs, here illustrated as the moving lug 37; a second section 53, journaled to rotate within a bore in the other adjustment lug 25; and a distal section 54, extending beyond the two assembled plates 21, 31; all as best shown by FIG. 2. The portion of the shaft 51 on the internal side of the adjustment lug 25 is larger in diameter than the distal and journaled portions. The journaled portion is held in place between a shoulder 55 and a collar 56 fixed to the shaft 51 by suitable means, such as a rollpin 57. A tight fit is assured by compressible washers 58. The distal portion 54 of the shaft 51 may be provided with suitable means, such as a knob 60, FIG. 4, to facilitate rotation of the shaft.

A typical application of this invention is illustrated by FIG. 4, wherein the way system is adapted to adjust the spacings between grind stones 65, 66 in a grain mill. As shown, the stationary mounting plate 21 is fixed to one side of a mounting panel 70 of the mill. An electrical motor 71 mounted within a standard electric motor mounting frame 72 is installed on the opposite side of the mounting panel 70 with the shaft 73 of the motor extending into a grinding chamber 74. Grain fed into a hopper 75 enters through a hole 76 into a central cavity defined by the stones 65, 66. The fineness of grind is adjusted by advancing or retracting the motor 71 along its axis. The base plate 80 of the frame is mounted to the load-bearing platforms 38 of the movable way element 31 by means of four mounting posts 81, each of which extends above the stationary way element 21 through holes (not visible in the drawing) in the mounting panel 70. These posts 81 are sufficient in length to assure slight clearance between the upper surface of the panel 70 and the base plate 80. In operation, the spacing between the stones 65, 66 is adjusted by turning the knob 60 selectively to advance or retract the movable way element 31 with respect to the stationary way element 21.

It will be noted that the stone 66 is mounted as a stator and the stone 65 is carried at the distal end of the shaft 73 as a rotor. Accordingly, the motor is rigidly anchored through ways to the flour mill, and the stone 66 is rigidly mounted to a panel 85, which may be fixed almost exactly at right angles to the mounting panel 70. The rotor stone 65 is rigidly coupled to the rotor of the motor approximately normal the axis of the shaft. Small variances between motors, cabinets, stone surfaces, motor frames, etc. inherently introduce misalignments of the surfaces between the rotor 65 and stator 66 stones of a newly assembled mill. According to this invention, means may be provided in association with the posts 81 to adjust their lengths, thereby to correct such misalignment of the stones 65, 66. Advancing and retracting the motor by means of the ways is accomplished without altering the orientations of the stones 65, 66. This feature greatly enhances the dependability of such mills which have generally been characterized by operation difficulties associated with inadequate alignment of the grinding surfaces.

Reference herein to details of the illustrated embodiment should not be taken as limiting the scope of the appended claims which themselves recite those features regarded as essential to the invention.

I claim:

1. A way system for selectively advancing and retracting an electric motor along its axis, comprising:

a first way element, including a stationary mounting plate with a flush-mounting surface, a pair of parallel way surfaces depending from said mounting plate opposite said flush-mounting surface, and a first adjusting lug depending from said mounting plate between said depending way surfaces;

a second way element, including a movable support plate, a pair of parallel way surfaces upstanding from said support plate and arranged to register with respective said depending way surfaces, and a second adjusting lug upstanding from said support plate between said upstanding way surfaces;

a shaft with a first threaded portion engaged by threads in one of said adjusting lugs, a second portion journaled through the second adjusting lug, and a distal end portion extending beyond said plates, constituting adjusting means for changing the relative longitudinal position of said movable support plate with respect to said stationary mounting plate;

parallel motor support platforms associated with each of said upstanding way surfaces and carried approximately parallel said flush-mounting surface of said stationary mounting plate; and mounting posts upstanding from respective said motor support platforms arranged to register with anchoring slots of a conventional electric motor frame mounting and sufficiently long to provide clearance between the distal ends of said posts and said flush-mounting surface to accommodate a mounting panel such that the mounting plate may be fastened to one side of such a mounting panel with the mounting posts extending through holes provided in said panel, and a motor frame mounting attached to the distal ends of said posts to slightly clear the opposite surface of said mounting panel.

2. In a grain mill having an approximately horizontal motor support base with a mounting surface, an electric motor mounted above said support base with the shaft of said motor approximately parallel said mounting surface, and a grinding chamber including a stator stone mounted approximately normal said mounting surface and a rotor stone carried by the distal end of said motor shaft in approximately axial alignment with said stator stone, the improvement which comprises:

a way system for selectively advancing and retracting said electric motor along its axis, including:

a first way element, including a stationary mounting plate with a flush-mounting surface anchored against the mounting surface of said motor support base, a pair of parallel way surfaces depending from said mounting plate opposite said flush-mounting surface, and a first adjusting lug depending from said mounting plate between said depending way surfaces;

a second way element, including a movable support plate, a pair of parallel way surfaces upstanding from said support plate and arranged to register with respective said depending way surfaces, and a second adjusting lug upstanding from said support plate between said upstanding way surfaces;

a shaft with a first threaded portion engaged by threads in one of said adjusting lugs, a second portion journaled through the second adjusting lug, and a distal end portion extending beyond said plates, constituting adjusting means for changing the relative longitudinal position of said movable support plate with respect to said stationary mounting plate;

parallel motor support platforms associated with each of said upstanding way surfaces and carried approximately parallel said flush-mounting surface of said stationary mounting plate; and mounting posts upstanding from respective said motor support platforms and extending through holes in said motor support base, said motor being carried at the distal ends of said posts.

3. An improvement according to claim 2 wherein said mounting posts are arranged to register with anchoring slots of a standard electric motor frame mounting, said motor is carried by such a standard frame mounting, and said mounting is anchored to said posts.

4. An improvement according to claim 3 wherein said motor frame mounting is held by said posts to allow only slight clearance between said frame mounting and said motor support base.

* * * * *